United States Patent [19]

Hashimoto et al.

[11] Patent Number: 4,755,283

[45] Date of Patent: Jul. 5, 1988

[54] FLUID CATALYTIC CRACKING OF HEAVY HYDROCARBON OIL

[75] Inventors: Hideo Hashimoto, Sagamihara; Toru Takatsuka, Yokohama; Shuzo Satoh, Kanagawa; Yasuyuki Morimoto, Yokohama, all of Japan

[73] Assignee: Chiyoda Chemical Engineering & Constr., Japan

[21] Appl. No.: 938,450

[22] Filed: Dec. 5, 1986

[51] Int. Cl.[4] ..... C10G 11/05

[52] U.S. Cl. ..... 208/120

[58] Field of Search ..... 208/120, 122; 502/64

[56] References Cited

U.S. PATENT DOCUMENTS

| | | | |
|---|---|---|---|
| 3,425,956 | 2/1969 | Baker et al. | 502/64 |
| 3,912,619 | 10/1975 | Magee, Jr. et al. | 208/120 |
| 3,944,482 | 3/1976 | Mitchell et al. | 208/120 |
| 4,217,240 | 8/1980 | Bergna | 208/120 |
| 4,257,874 | 3/1981 | Bergna | 208/111 |
| 4,310,441 | 1/1982 | Alafandi et al. | 502/235 |
| 4,362,651 | 12/1982 | Schwarzenbek | 208/120 |
| 4,457,833 | 7/1984 | Zandona et al. | 208/120 |
| 4,624,773 | 11/1986 | Hettinger, Jr. | 208/120 |

*Primary Examiner*—Anthony McFarlane

*Attorney, Agent, or Firm*—Lorusso & Loud

[57] ABSTRACT

A method of cracking a heavy hydrocarbon oil containing a residual fraction with a boiling point of 538° C. or higher, including contacting the heavy hydrocarbon oil with a fluidized bed of a particulate composite catalyst which includes an amorphous refractory inorganic oxide and a crystalline aluminosilicate dispersed in the oxide and which has a surface area distribution such that the surface area of pores having pore diameters in the range of from three times to six times the average molucular size of the residual fraction is at least 60% of the surface area of pores having pore diameters in the range of 15–150 Å.

5 Claims, No Drawings

FLUID CATALYTIC CRACKING OF HEAVY HYDROCARBON OIL

BACKGROUND OF THE INVENTION

This invention relates to a method for the conversion of a heavy hydrocarbon oil into a light hydrocarbon oil using a fluid catalytic cracking technique.

While there are increasing demands for light hydrocarbons, petroleum crude produced is now becoming heavier and heavier. In this circumstance, the establishment of effective techniques for converting heavy hydrocarbon oils into light hydrocarbon oils is strongly desired.

There is known a fluid catalytic cracking (FCC) method which has been developed for the production of light hydrocarbon oils such as gasoline and light cycle oil from heavy distillates such as gas oil and vacuum gas oil. The FCC method, in which a zeolite catalyst such as refractory inorganic oxide composited with crystalline aluminosilicate (zeolite) is generally used as the catalyst, has not been adopted for the conversion of heavy hydrocarbon oils containing a residual fraction with a boiling point of 538° C. or higher. This is because the heavy hydrocarbon oils contain a large amount of metals such as vanadium, nickel, iron and copper and carbon residue which cause the deactivation of the catalyst, resulting in the reduction of the yield of valuable fractions such as gasoline and light cycle oil and the increase of the yield of dry gas fractions such as hydrogen and $C_2$ lighter hydrocarbons and coke.

SUMMARY OF THE INVENTION

It is, therefore, an object of the present invention to provide a method of converting a heavy hydrocarbon oil into a light hydrocarbon oil using an FCC technique without encountering the problems of the conventional method.

It is a special object of the present invention to provide an FCC method which can produce valuable fractions such as gasoline and light cycle oil with a high yield from heavy hydrocarbon oils.

In accordance with the present invention there is provided a method of cracking a heavy hydrocarbon oil containing a residual fraction with a boiling point of 538° C. or higher, said method comprising contacting the heavy hydrocarbon oil with a fluidized bed of a particulate composite catalyst which includes an amorphous refractory inorganic oxide and a crystalline aluminosilicate dispersed in said oxide and which has a surface area distribution such that the surface area of pores having pore diameters in the range of from three times to six times the average molucular size of said residual fraction is at least 60% of the surface area of pores having pore diameters in the range of 15–150 Å.

In the method according to the present invention, a heavy hydrocarbon oil containing a residual fraction with a boiling point of 538° C. or higher is subjected to a fluid catalytic cracking treatment using a specific catalyst having a pore diameter distribution suitably controlled according to the average molecular size of the residual fraction. By this, the production of coke and invaluable gaseous components may be minimized while improving the yield of valuable components such as gasoline and intermediate fractions.

The catalytic conversion in the present invention is considered to proceed as follows. The macromolecules of the residual fraction are first cracked at acidic active sites on the amorphous refractory inorganic oxide of the catalyst to the extent that the cracked molecules can diffuse into the pores of the zeolite crystals. Thus, the cracked products are then further cracked within the zeolite crystals to yield gasoline and light cycle oil.

In the conventional FCC technique using a zeolite catalyst, a distillate feed stock is contacted with the catalyst at a temperature of 475°–530° C. in a reactor. Under such a reaction condition, most of the distillate is vaporized. The vaporized reactants, whose molecular sizes are smaller than the pore diameters (7–8 Å) of the zeolite crystals, can be freely diffused through the pores of the catalyst and can diffuse into the zeolite crystals. The reactants which have diffused into the zeolite crystals are catalytically cracked to form mainly gasoline and light cycle oil. On the other hand, when the above FCC technique is applied as such to the treatment of a heavy hydrocarbon oil containing a residual fraction, the residual fraction cannot be vaporized but remains present in a liquid state. Therefore, the residual fraction cannot be freely diffused into the pores of the catalyst. Moreover, since the molecular size of the residual fraction is greater than 10 Å, the molecules cannot diffuse into the zeolite crystals. As a consequence, the residual fraction is subjected to conditions as if thermally cracked in the absence of a catalyst rather than catalytically cracked, so that the formation of coke and dry gas fractions is accelerated.

Other objects, features and advantages of the present invention will become apparent from the detailed description of the invention to follow.

DETAILED DESCRIPTION OF THE INVENTION

The catalyst used in the method of the present invention is a composite catalyst composed of crystalline aluminosilicate (zeolite) dispersed, generally homogeneously, in a matrix of amorphous refractory inorganic oxide. Any aluminosilicate generally used in the conventional FCC method may be suitably used in the present invention. As the refractory inorganic oxide forming the matrix of the catalyst, there may be mentioned any conventional refractory materials, such as gamma-alumina, alpha-alumina, silica, magnesia, boria, zirconia, phosphia, chromia, titania, silica-alumina, alumina-boria, alumia-phosphia and silica-magnesia. The content of the crystalline aluminosilicate in the catalyst is generally 5–50% by weight, preferably 15–35% by weight. The composite catalyst may be prepared by any known method such as described in U.S. Pat. No. 3,425,956.

The composite catalyst should have a specific pore characteristics determined in connection with the average molecular size of the residual fraction contained in the heavy hydrocarbon oil. That is, it is essential that the surface area of pores of the catalyst having a range of pore diameters D expressed by the equation (1):

$$3M \leqq D \leqq 6M \quad (1)$$

wherein D represents the pore diameter range (Å) and M represents the average molecular size (Å) of the residual fraction with a boiling point of 538° C. or higher, should be at least 60% , preferably at least 65% of the surface area of pores having pore diameters of 15–150 Å in order to achieve the object of the present invention.

It has been found that the residual fraction can be relatively easily diffused into the pores having a pore diameter range of D, i.e. pore diameters in the range of from three times to six times the average molecular size of the residual fraction, and can efficiently undergo catalytic cracking. Pores of the catalyst which have pore diameters smaller than 3M tend to inhibit the diffusion of the residual fraction thereinto and tend to be plugged with the residual fraction. As a result, the catalytic cracking of the residual fraction fails to effectively proceed but, rather, the residual fraction is subjected to non-catalytic thermal cracking to form coke and dry gas fractions. Further, the light fraction with a boiling point of below 538° C. and cracked products are prevented from diffusing into the pores of the zeolite crystals. On the other hand, pores having pore diameters greater than 6M are poor in catalytic activity in cracking the residual fraction due to the decrease of surface area. As a result, the residual fraction tends to undergo non-catalytic thermal cracking, forming coke and dry gas fractions in a large amount.

The particulate composite catalyst used in the method of the present invention generally has a pore volume of 0.07 ml/g or more, preferably 0.08–0.21 ml/g in pores having pore diameters of 15–150 Å and a surface area of 50 $m^2/g$, preferably 60–110 $m^2/g$ in pores having pore diameters of 15–150 Å. The particle diameter of the composite catalyst may be that of the conventional FCC catalyst and is generally in the range of 10–150 μm.

The heavy hydrocarbon oils to be cracked in accordance with the method of the present invention and containing a residual fraction with a boiling point of 538° C. or higher may be, for example, residual oils such as atmospheric distillation residues, vacuum distillation residues and mixtures thereof, and mixtures of the residual oils and vacuum distillate oils such as vacuum gas oils. The content of the residual fraction with a boiling point of 538° C. or higher in the heavy hydrocarbon oil is generally at least 5% by weight, preferably 10–70 % by weight. The residual fraction generally has an average molecular size of 10 Å or more.

The fluid catalytic cracking in the method of the present invention is generally performed at a temperature of 450°–550° C., preferably 480°–535° C., a pressure of 0–3 $kg/cm^2G$, preferably 0.5–2 $kg/cm^2G$ and a weight hourly space velocity of 10–300 $hour^{-1}$, preferably 70–120 $hour^{-1}$. Details of fluid catalytic cracking are described, for instance, in Hydrocarbon Processing vol. 51, No. 9 (1972).

The terms "pore diameter", "surface area" and "pore distribution" used in the present specification are intended to refer to those measured by the nitrogen adsorption method (BET method). The "average molecular size" of the residual fraction having a boiling point of 538° C. or higher and contained in the heavy hydrocarbon oil may be calculated on the basis of the average moclecular structure elucidated from the results of measurement of $^1$H-NMR, average molecular weight and elementary analysis. The details are described in The Journal of Japan Petroleum Society 24, No. 3, 151–159, (1981).

The following examples will further illustrate the present invention.

EXAMPLE 1

Two kinds of heavy hydrocarbon oils (I) and (II) having the properties shown in Table 1 were subjected to thermal cracking with the use of Catalysts (A)–(D) having the compositions and properties shown in Table 2. Catalyst (A) is a conventional zeolite catalyst, while Catalysts (B)–(D) are composite catalysts containing zeolite dispersed in amorphous silica-alumina matrix. Catalysts (A)–(D) were treated with steam at 780° C. for controlling their pore structures.

TABLE 1

| Properties of Feed Stock | Feed Stock (I) | Feed Stock (II) |
|---|---|---|
| 343–538° C. Fraction (wt %) | 37.5 | 75.0 |
| 538° C. + Fraction (wt %) | 62.5 | 25.0 |
| Properties of 538° C. + fraction | | |
| Specific gravity (d15/4° C.) | 0.945 | 1.02 |
| Sulfur content (wt %) | 0.3 | 4.8 |
| Conradson carbon residue (wt %) | 3.2 | 6.3 |
| Average molecular weight | 590 | 964 |
| Average molecular size (Å) | 10 | 16 |

TABLE 2

| Composition and Properties of Catalysts | | | | |
|---|---|---|---|---|
| Catalyst | (A) | (B) | (C) | (D) |
| Composition (wt %) | | | | |
| $Al_2O_3$ | 33.6 | 45.7 | 46.9 | 46.3 |
| $Na_2O$ | 0.8 | 0.3 | 0.3 | 0.3 |
| MgO | 0.5 | 0.6 | 0.9 | 0.6 |
| Fe | 0.2 | 0.1 | 0.1 | 0.1 |
| $SiO_2$ | balance | balance | balance | balance |
| Properties | | | | |
| Surface area ($m^2/g$) | 92.7 | 86.2 | 86.4 | 86.6 |
| Apparent bulk density (g/cc) | 0.74 | 0.76 | 0.81 | 0.79 |

In Table 2, "surface area" is the surface area of pores having pore diameters of 15–150 Å and is measured by the BET method.

The cracking test was performed at a temperature of 500° C. and with a catalyst to oil ratio of 8.0 (wt/wt) using a fluid catalytic cracking pilot test unit. The results were as summarized in Table 3, in which "pore diameter range D" is as defined by the equation (1) shown above and "conversion" is as defined as follows:

$$Conversion\ (wt\ \%) = (B \times 100)/A$$

where A represents the amount of a fraction in the feed stock having a boiling point of 221° C. or more and B represents the amount of a fraction in the product oil having a boiling point of 221° C. or more (except coke).

As is evident from the results shown in Table 3, Experiments Nos. 2 and 5 according to the present invention give gasoline and light cycle oil with a higher yield while reducing the production of coke as compared with the other experiments. It will be appreciated from the comparison between the results of Experiment Nos. 2 and 4 that even when the catalyst used is otherwise the same, i.e. Catalyst (B), the results are significantly inferior in the case of treatment of a feed stock whose residual fraction with a boiling point of at least 538° C. or higher has such an average molecular size that the surface area $SA_D$ of pores having a pore diameter range of D is less than 60% of the surface area $SA_T$ of pores having pore diameters in the range of 15–150 Å.

TABLE 3

| Experiment No. | 1* | 2 | 3* | 4* | 5 | 6* |
|---|---|---|---|---|---|---|
| Feed stock | (I) | (I) | (I) | (II) | (II) | (II) |
| Average molecular size of residual fraction (Å) | 10 | 10 | 10 | 16 | 16 | 16 |
| Catalyst | (A) | (B) | (C) | (B) | (D) | (A) |
| Pore diameter range D (Å) | 30–60 | 30–60 | 30–60 | 48–96 | 48–96 | 48–96 |
| Surface area distribution S (%)** | 17 | 61 | 37 | 37 | 37 | 11 |
| Results of Cracking | | | | | | |
| Conversion (wt %) | 76.9 | 75.9 | 76.6 | 77.2 | 77.2 | 69.3 |
| Yield (wt %) | | | | | | |
| Gas (C4—) | 19.8 | 15.5 | 16.4 | 20.2 | 17.2 | 22.0 |
| Gasoline (C5-221° C.) | 44.7 | 51.3 | 47.8 | 43.5 | 50.7 | 35.2 |
| Light cycle oil (221–343° C.) | 10.8 | 15.5 | 13.7 | 8.7 | 12.6 | 8.5 |
| Heavy cycle oil (above 343° C.) | 12.3 | 8.6 | 9.7 | 14.1 | 10.2 | 22.2 |
| Coke | 12.4 | 9.1 | 12.4 | 13.5 | 9.3 | 12.1 |

*Comparative example

**$S = (SA_D \times 100)/SA_T$ where $SA_D$ respresents the surface area of pores with pore diameters D and $SA_T$ represents the surface area of pores with pore diameters in the range of 15–150 Å

We claim:

1. A method of cracking a heavy hydrocarbon oil containing a residual fraction with a boiling point of 538° C. or higher, said method comprising contacting the heavy hydrocarbon oil with a fluidized bed of a particulate composite catalyst which includes an amorphous refractory inorganic oxide and a crystalline aluminosilicate dispersed in said oxide, said crystalline aluminosilicate having a surface area distribution such that the surface area of pores having pore diameters in the range of from three times to six times the average molecular size of said residual fraction is at least 60% of the surface area of pores having pore diameters in the range of 15–150 Å.

2. A method as claimed in claim 1, wherein the content of said residual fraction in the heavy hydrocarbon oil is at least 5% by weight.

3. A method as claimed in claim 1, wherein said particulate catalyst has a pore volume of at least 0.07 ml/g in pores with pore diameters of 15–150 Å and a surface area of at least 50 $m^2/g$ in pores with pore diameters of 15–150 Å.

4. A method as claimed in claim 1, wherein said contact is at a temperature of 450°–550° C., a pressure of 0–3 $kg/cm^2G$ and a weight hourly space velocity of 10–300 $hour^{-1}$.

5. The method of claim 1 wherein the content of said residual fraction in the heavy hydrocarbon oil is 10–70% by weight.

* * * * *

UNITED STATES PATENT AND TRADEMARK OFFICE

CERTIFICATE OF CORRECTION

PATENT NO. : 4,755,283

DATED : July 5, 1988

INVENTOR(S) : Hideo HASHIMOTO et al

It is certified that error appears in the above-identified patent and that said Letters Patent is hereby corrected as shown below:

Col. 5, line 8, (Surface area distribution for Experiment No. 5), "37" should read --80--.

Signed and Sealed this

Eighth Day of November, 1988

*Attest:*

DONALD J. QUIGG

*Attesting Officer*

*Commissioner of Patents and Trademarks*